United States Patent [19]

Williams

[11] 4,182,459

[45] Jan. 8, 1980

[54] SAFETY RECEPTACLE

[76] Inventor: Clarence E. Williams, 2122 W. 450 N., La Porte, Ind. 46350

[21] Appl. No.: 25,036

[22] Filed: Mar. 29, 1979

[51] Int. Cl.[2] ..... B65D 25/00

[52] U.S. Cl. ..... 220/88 R

[58] Field of Search ..... 220/88 R, 335, 89 B

[56] References Cited

U.S. PATENT DOCUMENTS

| | | | |
|---|---|---|---|
| 1,683,571 | 9/1928 | Mueller | 220/88 R |
| 1,832,056 | 11/1931 | Spencer | 220/88 R |
| 1,993,507 | 3/1935 | Flegel | 220/88 R |
| 2,155,464 | 4/1939 | Anschicks | 220/88 R |
| 2,267,069 | 12/1941 | Anschicks | 220/88 R |
| 2,313,350 | 3/1943 | Lebus | 220/88 R |
| 2,440,619 | 4/1948 | St. Laurence | 220/88 R |
| 2,452,118 | 10/1948 | Florence | 220/88 R |
| 2,679,949 | 6/1954 | Clinton | 220/88 R |

*Primary Examiner*—Steven M. Pollard

*Attorney, Agent, or Firm*—Oltsch, Knoblock & Hall

[57] ABSTRACT

A fusible link restrains a spring which in turn is connected to a chain or similar flexible retainer member extending between the housing part of the receptacle and the hinged lid part of the receptacle. In the presence of heat the link melts causing the spring to exert a pull upon the chain which pulls the lid part of the receptacle closed.

3 Claims, 6 Drawing Figures

SAFETY RECEPTACLE

SUMMARY OF THE INVENTION

This invention relates to a safety receptacle and will have specific but not limited application to a cleaning or dip tank.

Cleaning or dip tanks contain flammable liquid which is utilized to dissolve or remove grease and oil from machined parts. The parts are dipped or lowered into the liquid and thereafter removed when cleaned. During working hours, the lid of the cleaning tank is usually left in its open position to facilitate the cleaning and dipping operation. Dip tanks of this nature, as indicated in U.S. Pat. No. 3,613,942, have been provided with safety devices should a fire occur within the tank because of accidental ignition of the flammable liquid. If such a fire occurs, the lid of the tank will automatically close causing the fire within the tank to be extinguished In this invention the lid of the receptacle is hinged to the receptacle housing with a chain or other type of flexible retainer member extending between the housing and the lid. One end of the chain is connected to an actuator associated with a fusible link. When the link melts due to heat within the vicinity of the tank, a spring which forms a part of the actuator pulls upon the chain to pull the lid from an over-center position into a closed position spanning the receptacle housing. The actuator and its component parts are housed within the interior of the receptacle when the lid is in its closed position spanning the housing.

By locating the actuator for closing the receptacle lid within the interior of the receptacle when the lid is closed, one is able to store and stack or ship the receptacles one on top of the other. This arrangement is not possible when a safety receptacle is constructed in accordance with the teachings of U.S. Pat. No. 3,613,942 which locates the actuator at the exterior face of the receptacle lid.

Accordingly, it is an object of this invention to provide a safety receptacle having a pivoted lid which automatically closes in the presence of excessive heat.

Another object of this invention is to provide a safety receptacle which has a pivoted lid and which includes an actuator of reliable operation for closing the lid in the presence of excessive heat.

Still another object of this invention is to provide a dip or cleaning tank having sensitive automatic means for closing the lid of the tank in the presence of fire.

Still another object of this invention is to provide a dip or cleaning tank which has a lid that closes automatically in the case of fire and which is of economical construction.

Other objects of this invention will become apparent upon a reading of the invention's description.

BRIEF DESCRIPTION OF THE DRAWINGS

A preferred embodiment has been chosen for purposes of illustration and description wherein.

DESCRIPTION OF THE PREFERRED EMBODIMENT

Figure 1:
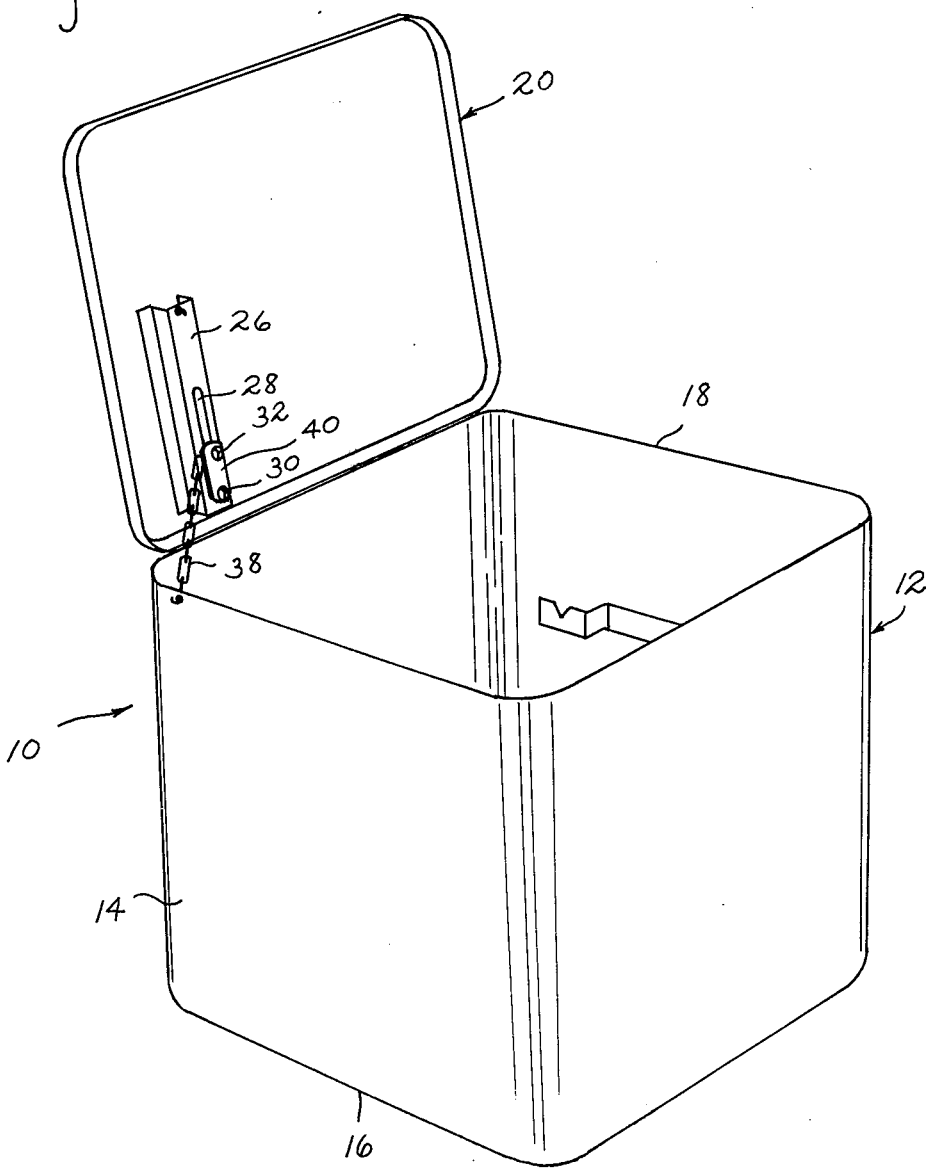
FIG. 1 is a perspective view of a receptacle with its lid in its over-center open position.

The preferred embodiment illustrated is not intended to be exhaustive or to limit the invention to the precise form disclosed. It is chosen and described in order to best explain the principles of the invention and its application and practical use to enable others skilled in the art to best utilize the invention.

Receptacle 10 includes a housing 12 having a side wall 14 and a bottom wall 16. Side wall 14 extends upwardly from bottom wall 16 and terminates in an upper marginal edge 18. A lid 20 is connected to housing 12 by a hinge connection 22. Lid 20 is shiftable between a closed position spanning the housing opening defined by the marginal edge 18 of side wall 14 and an open over-center position, shown in the FIGS. 1 and 2, with the lid contacting and being supported by a flange 24 carried by housing 12 adjacently below hinge connection 22. Housing 12 and lid 20 are preferably constructed from metal, such as steel.

An inverted channel-shaped bracket 26 is carried at the inside surface of lid 20. Bracket 26 is located next to one side edge of the lid, paralleling the side edge and extending from adjacent lid hinge connection 22. A slot 28 is formed in bracket 26 and a pin 30 is carried at one end of the bracket next to hinge connection 22. A pin 32 extends into slot 28 and is connected to one end of a helical spring 34. Spring 34 is located within bracket 26 and has its opposite end connected to that end of the bracket oppositely located from pin 30. A plate 36 is also connected to pin 32 and is located between the pin and the spring within the interior of bracket 26 overlying slot 28 of the bracket. Plate 36 serves to locate pin 32 within bracket slot 28 and to prevent the pin from becoming displaced within the bracket as spring 34 is extended.

Figure 2:
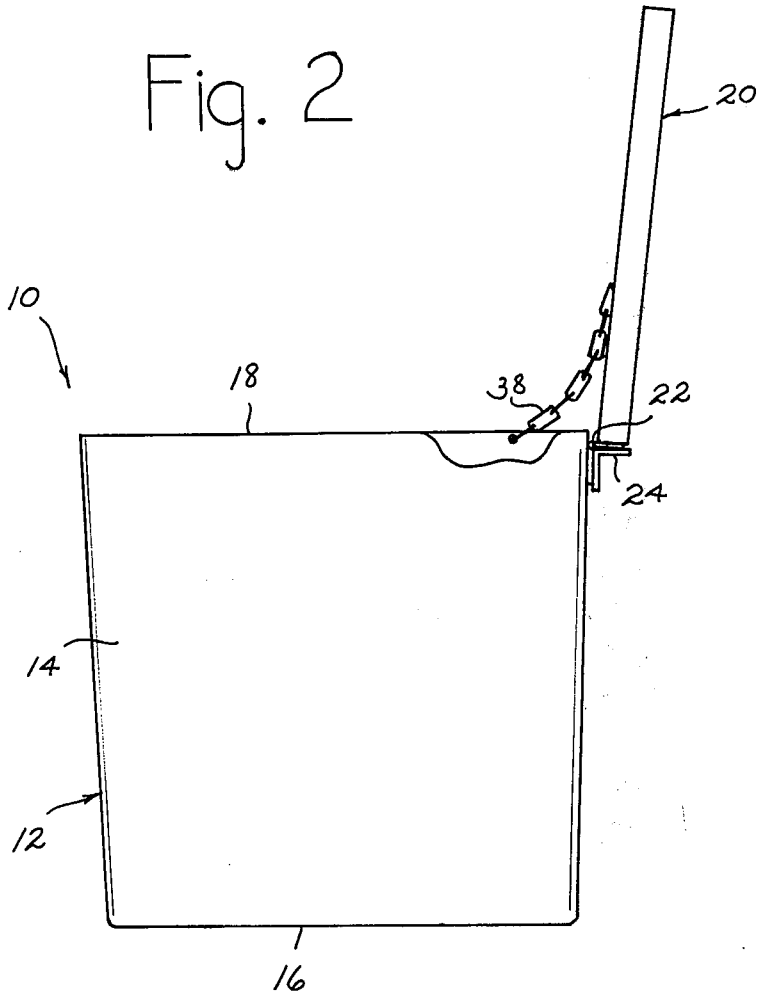
FIG. 2 is a side view of the receptacle as seen with its lid in its open over-center position.
Figure 3:
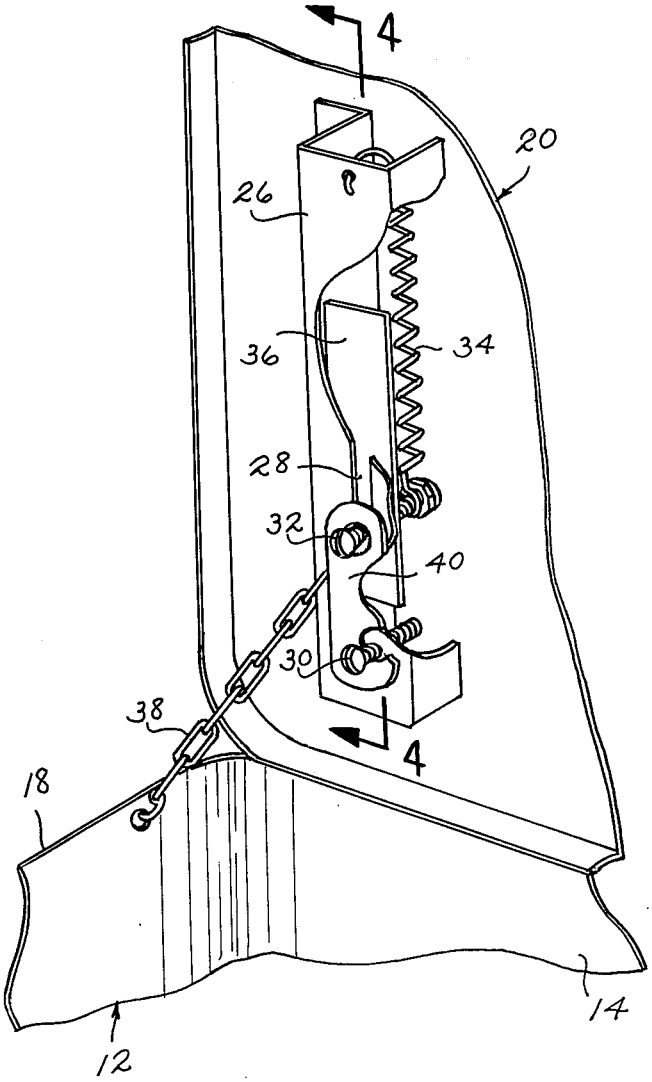
FIG. 3 is a detailed fragmentary perspective view of the anchor and closing actuator for the receptacle lid, having portions broken away for purposes of illustration.
Figure 4:
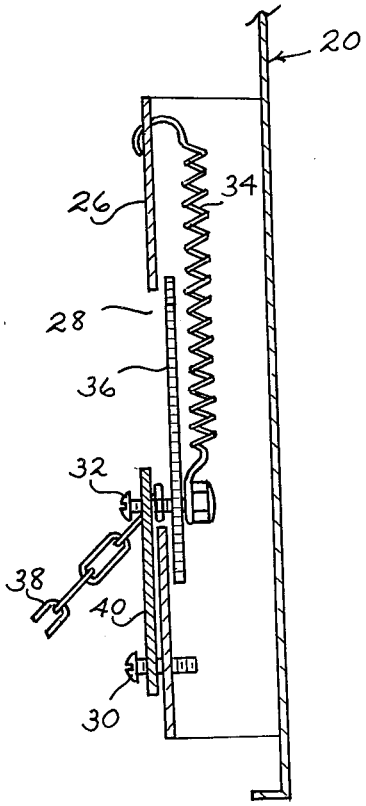
FIG. 4 is a fragmentary sectional view taken along line 4—4 of FIG. 3.
Figure 5:
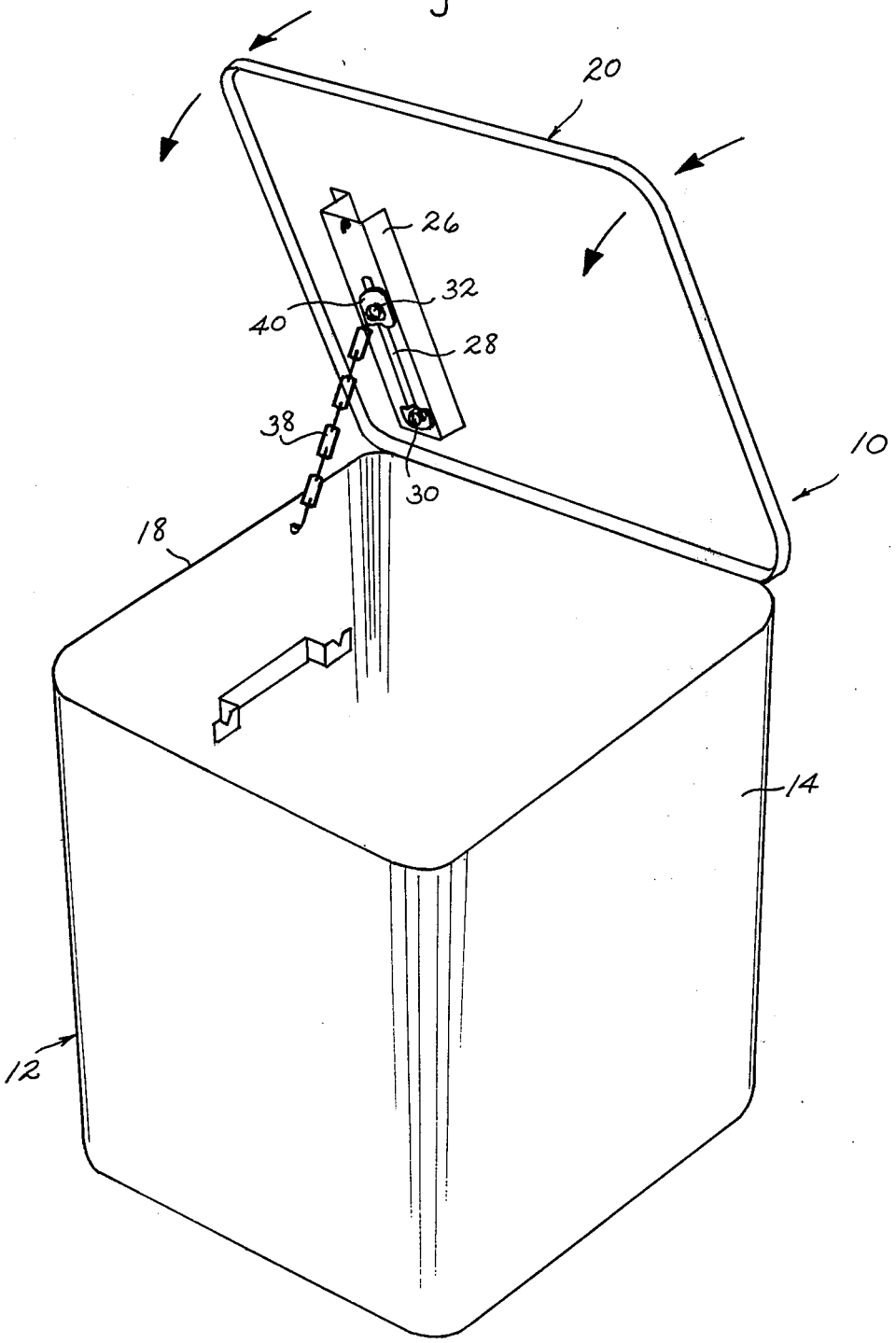
FIG. 5 is a fragmentary perspective view showing the lid of the receptacle as having passed through its open over-center position.

A chain 38 extends between housing 12 and lid 20. One end of chain 38 is connected to the marginal edge 18 of housing side wall 14 and its other end is connected to pin 32 where it projects from bracket slot 28. With spring 34 extended and pin 32 positioned near pin 30, lid 20 is located in its open over-center position resting against flange 24, as seen in FIGS. 1 and 2. Pin 32 and its extended connected spring 34 is maintained in this normal operative position by a fusible link 40 extending between pins 30 and 32.

Figure 6:
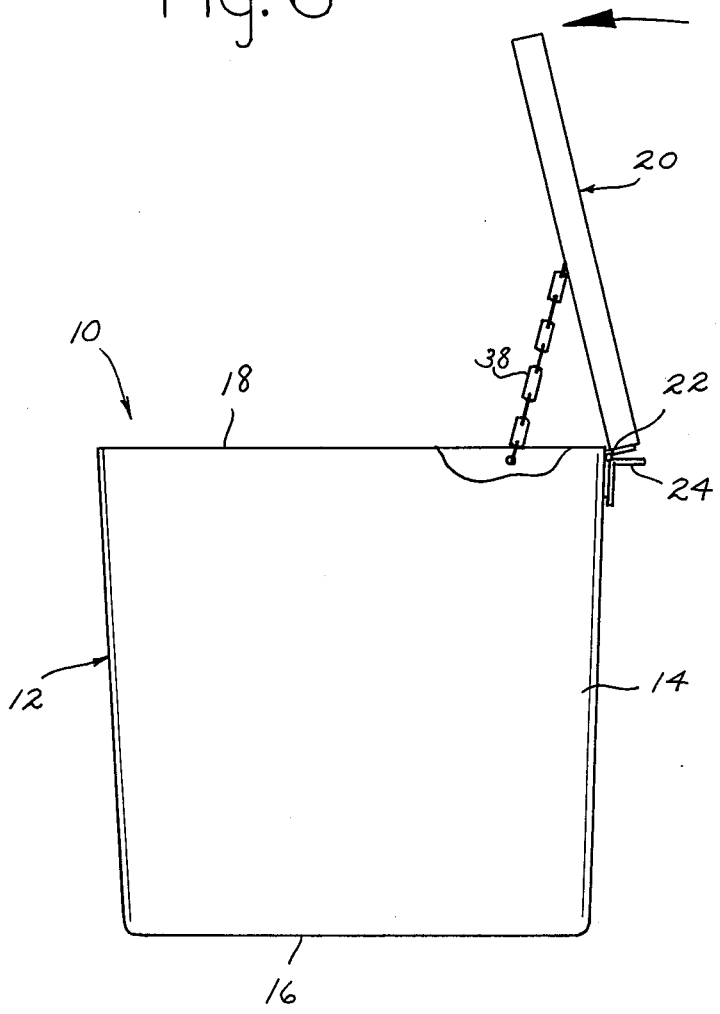
FIG. 6 is a side view of the receptacle shown with its lid having passed through its open over-center position.

Whenever a fire or an excessive heat source occurs in the vicinity of link 40, the link melts or separates allowing spring 34 to retract and shift pin 32 within slot 28 away from pin 30. This movement of pin 32 causes a pull upon chain 38 which in turn causes lid 20 to be urged through its over-center position as illustrated in FIG. 6. Once lid 20 is pulled through its over-center position, the lid may fall by its own weight or gravity into its closed position. Depending upon the length of slot 28 and chain 38, the pull upon the chain induced by the retraction of spring 34 may serve as a positive assist in fully closing lid 20 in addition to the normal closing action of the lid due to its gravitational fall.

Additionally, though not preferred, housing 12 need not include lid supporting flange 24. Lid 20 may be retained in its open over-center position by the holding action of chain 38 with link 40 secured between pins 30 and 32. When receptacle 10 is utilized as a cleaning or dip tank, link 40 will normally melt or separate to allow the automatic closing of lid 20 when the ambient temperature about the link reaches 160° F. The close proximity of link 40 to the interior of housing 12 even with lid 20 open produces a sensitive safety control which will cause the closing of the lid and the extinguishment of any fire within receptacle 10 should a fire occur within receptacle housing 12. This is to be contrasted with the less desirable location of the lid actuator of the safety tank disclosed in U.S. Pat. No. 3,613,942.

It is to be understood that the invention is not to be limited to details above given but may be modified within the scope of the appended claims.

What I claim is:

1. In a safety receptacle having a housing part and a lid part, said housing part including a bottom wall and a side wall extending upwardly from the bottom wall and terminating in an upper marginal edge defining an opening into the housing part, a hinge connection connecting said lid part to said housing part adjacent its side wall upper marginal edge, said lid part being shiftable about said hinge connection between a closed position spanning said opening and an open over-center position, said lid part being shiftable into its closed position by the weight of the lid part after being moved through its open over-center position, the improvement comprising a flexible retainer member having one end connected to one of said housing and lid parts spaced from said hinge connection, shiftable anchor means including a heat sensitive actuator and connecting the other end of said retainer member to the other of said housing and lid parts spaced from said hinge connection, said anchor means upon actuation of said heat sensitive actuator for pulling on said flexible retainer and thereby urging said lid part through its open over-center position to cause the lid part to shift into its closed position.

2. The safety receptacle of claim 1 wherein said anchor means includes a connector secured to said retainer member, said connector being shiftable under the influence of a biasing means between first and second positions, said heat sensitive actuator normally retaining said connector in its first position, said biasing means for urging said connector into its second position upon actuation of said heat sensitive actuator wherein said connector exerts a pull on said retainer member to urge said lid part through its open over-center position.

3. The safety receptacle of claim 2 wherein said biasing means is a helical spring connected at one end to said connector and at its other end to said other of the housing and lid parts, said heat sensitive actuator including a fusible link secured between said connector in its first position and said other of the housing and lid parts.

* * * * *